United States Patent [19]

Britz

[11] 4,379,469

[45] Apr. 12, 1983

[54] FIRE HYDRANT CAP WITH RECESSED VALVE

[76] Inventor: Arne J. Britz, 1775 W. 8th St., Brooklyn, N.Y. 11223

[21] Appl. No.: 335,767

[22] Filed: Dec. 30, 1981

[51] Int. Cl.[3] ..... E03B 9/06; E03B 9/14

[52] U.S. Cl. ..... 137/296; 137/800; 220/284

[58] Field of Search ..... 137/15, 294, 296, 315, 137/382, 382.5, 800; 220/284

[56] References Cited

U.S. PATENT DOCUMENTS

| | | | |
|---|---|---|---|
| 1,792,622 | 2/1931 | Wikstrom | 220/284 |
| 3,104,554 | 9/1963 | Mueller et al. | 137/296 |
| 3,453,655 | 7/1969 | Quinones et al. | 137/296 |
| 3,929,152 | 12/1975 | Graham | 137/296 |
| 3,935,877 | 2/1976 | Franceschi | 220/284 |
| 4,033,372 | 7/1977 | Bowman | 137/296 |
| 4,182,361 | 1/1980 | Oakey | 137/296 |

FOREIGN PATENT DOCUMENTS

| | | | |
|---|---|---|---|
| 619436 | 9/1935 | Fed. Rep. of Germany | 137/296 |

*Primary Examiner*—George L. Walton
*Attorney, Agent, or Firm*—Harvey B. Jacobson

[57] ABSTRACT

A multilobe bonnet is provided for the upper end of a fire hydrant with the multiple lobes thereof projecting upwardly from the bonnet at points spaced about and radially outwardly from the conventional pentagonal upper terminal end of the hydrant valve control rod, the upper terminal end projecting above the upper surfaces of the bonnet disposed centrally between the upwardly projecting lobes disposed thereabout. In addition, the side outlet closure caps of the hydrant are formed in a similar manner with the lobes on the bonnet preventing the engagement of a convention wrench with the valve control rod upper terminal end and the lobes on the closure caps similarly preventing engagement of conventional wrenches with the central pentagonal projections on the caps.

4 Claims, 3 Drawing Figures

FIG. 1
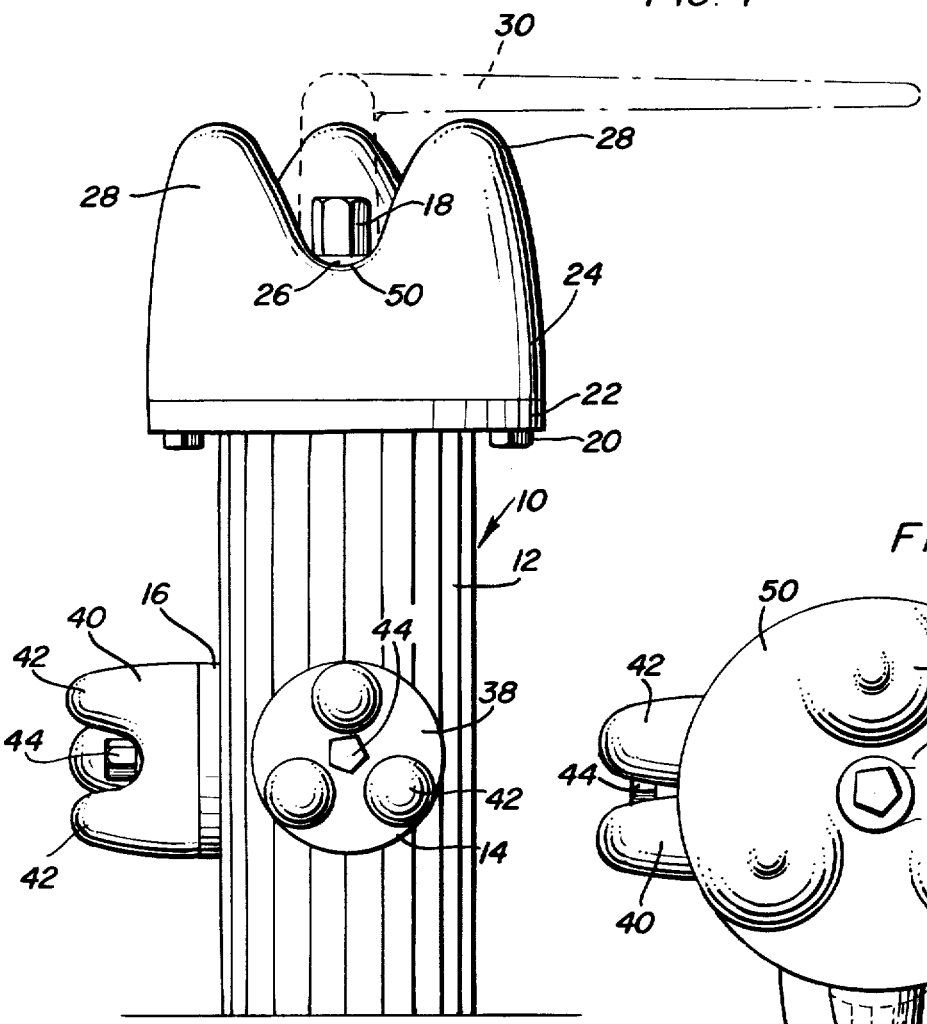
FIG. 2
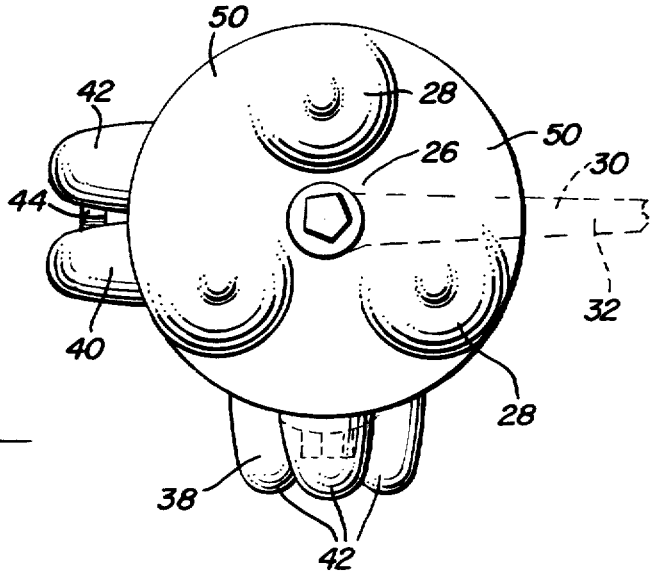
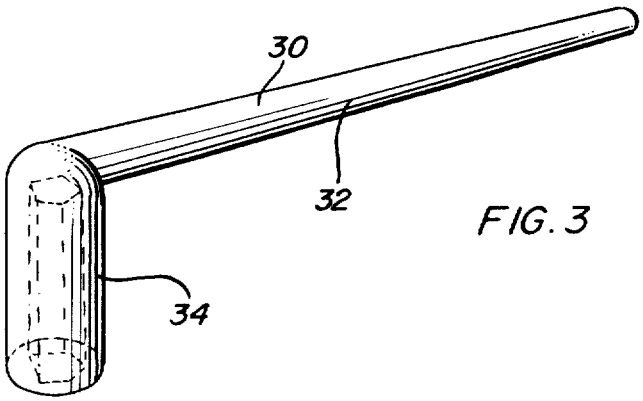
FIG. 3

FIRE HYDRANT CAP WITH RECESSED VALVE

BACKGROUND OF THE INVENTION

There are many instances in which fire hydrants experience unauthorized use and further instances wherein the side outlet caps of the hydrants are removed in an unauthorized manner.

While various forms of covers for the valve control rods of hydrants heretofore have been designed together with special wrenches and side outlet cap structures to prevent unauthorized use of fire hydrants and unauthorized removal of the side outlet caps thereof, most of these prior devices require multiple specially constructed components which are expensive to incorporate in existing fire hydrants. Accordingly, a need exists for structure whereby the engagement of the upper pentagonal terminal end of a fire hydrant control rod with a conventional wrench may be prevented and engagement of the central pentagonal projections on the side outlet caps of a hydrant by a conventional wrench may be prevented.

Examples of various forms of previously known devices including some of the general structural and operational features of the instant invention are disclosed in U.S. Pat. Nos. 3,453,655, 3,453,897, 3,916,939, 4,033,372 and Des. 211,342.

SUMMARY OF THE INVENTION

The improved hydrant bonnet and cap structure of the instant invention incorporates the provision of three upwardly projecting lobes on the bonnet of an associated fireplug spaced outwardly from the pentagonal upper terminal end of the valve control rod of the associated hydrant and the provision of similar horizontally outwardly projecting lobes spaced about and outwardly from the center pentagonal projection carried by the side outlet closure caps of a conventional fireplug.

The main object of this invention is to provide structure whereby unauthorized use of a fireplug as well as unauthorized removal of the side outlet cover caps thereof may be discouraged.

Yet another object of this invention is to provide an apparatus in accordance with the preceding object and retaining the ability of quick operation of the associated fireplug and removal of the side outlet caps thereof through the utilization of a specially constructed wrench.

Yet another object of this invention is to provide an improved fireplug bonnet and side outlet cap construction which may be readily retrofitted to existing fireplugs.

A final object of this invention to be specifically enumerated herein is to provide a structure in accordance with the preceding objects and which will conform to conventional forms of manufacture, be of simple construction and easy to use, so as to provide a device that will be economically feasible, long lasting and relatively trouble-free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a side elevational view of a fireplug including a bonnet and side outlet caps therefor constructed in accordance with the present invention;

FIG. 2 is a top plan view of the assemblage illustrated in FIG. 1; and

FIG. 3 is an enlarged perspective view of a wrench specially constructed for use in conjunction with the instant invention.

DETAILED DESCRIPTION OF THE INVENTION

Referring now more specifically to the drawings, the numeral 10 generally designates a conventional fire hydrant including an upstanding tubular body 12 having a pair of side lateral outlets 14 and 16 and a hydrant control valve rod equipped with a pentagonal upper terminal end 18. Conventionally, the upper end of the body 12 is equipped with a generally hemispherical bonnet (not shown) upwardly through the center of which the terminal end 18 projects. The conventional generally hemispherical bonnet is attached to the upper end of the body 12 through the utilization of suitable fasteners 20 secured through a mounting flange portion 22 carried by the upper end of the body 12 and threadedly engaged in the bonnet from the underside thereof. However, inasmuch as the terminal end 18 on a conventional fireplug is fully exposed from all horizontal directions, the terminal end 18 may be readily engaged by different forms of wrenches giving rise to at least occasional unauthorized usage of the fireplug 10.

In order to prevent such unauthorized usage, the instant invention incorporates a downwardly opening bonnet 24 secured to the mounting flange portion 22 through the utilization of the fasteners 20 and the bonnet 24 includes a central upper wall portion 26 through which the terminal end 18 projects. However, the bonnet 24 includes three upwardly projecting generally conical lobes 28 formed integrally therewith and spaced about and outwardly from the central upper wall portion 26. Thus, conventional wrenches may not be engaged with the terminal end 18 in order to turn the latter.

Rather, a specially designed wrench 30 including a horizontal handle 32 and a depending socket 34 on one end of the handle 32 must be used in order to engage and turn the terminal end 18. The effective vertical height of the socket 34 is at least slightly greater than the effective vertical height of the lobes 28 above the central upper wall portion 26. Therefore, the wrench 30 may be engaged with the terminal end 18 and the free end of the handle 32 may be swung about the center axis of the socket 34 in order to rotate the terminal end 18 for opening and closing the valve of the fire hydrant 10.

Also, the lateral side outlets 14 and 16 are conventionally provided with partial spherical closure caps whose center portions include non-circular projections which may likewise be engaged by a proper wrench. However, the hydrant 10 includes closure caps 38 and 40 threadedly engaged with the outlets 14 and 16 in the same manner as conventional closure caps, but the caps 38 and 40 are also provided with conical lobes 42 spaced about the central portions thereof from which non-circular projections 44 project for engagement by the socket 34 of the wrench 30. Of course, the lobes 42 also prevent conventional wrenches from being engaged with the projections 44.

It will be noted from FIG. 1 of the drawings that the central upper wall portion 26 through which the terminal end 18 upwardly projects is disposed at an elevation slightly higher than the lowest portions 50 of the upper marginal portions of the bonnet 24 disposed centrally intermediate adjacent lobes 28. Accordingly, any rain water falling onto the upper wall portion 26 of the bonnet 24 may drain radially outwardly of the outer marginal portions of the bonnet 24 between adjacent lobes 28 in order to prevent such water from collecting and freezing in sub-freezing weather. Further, it will be noted that the bonnet 24 comprises a full replacement for the conventional partial spherical bonnet and, therefore, that the bonnet 24 may be readily applied to the fire hydrant 10 as a replacement for the conventional bonnet thereof.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In combination with a valve body of the type including an upstanding tubular body and an uppr end bonnet secured over the upper end of said body, said bonnet including an upper central wall portion upwardly through which a rotatable valve actuating stem projects and is rotatably received, said bonnet including a plurality of upwardly projecting lobes spaced outwardly from and about said central portion, said stem including an upper terminal end defining a non-circular cross section wrench engageable portion for telescopic engagement thereof with a similar non-circular cross section rotary wrench shank terminal end, said lobes projecting above said central portion to an elevation spaced a predetermined distance above the upper terminal end of said stem, the lower portions of said lobes being spaced apart about said central portion, said bonnet defining water drainage zones thereof extending generally radially outwardly from said central portion between adjacent lobes and disposed at a lower elevation than said central portion, said bonnet being free of obstructions overlying said shank, lobes and water drainage zones, the upper ends of said lobes being smoothly rounded.

2. The fire hydrant combination of claim 1 including an elongated socket member having an endwise outwardly opening socket formed in one end thereof, said socket being non-circular in cross section and said one end of said socket member being telescopingly engageable downwardly over said terminal end for imparting rotary torque thereto, the other end of said socket member including a laterally extending handle spaced from said one end of said socket member a distance greater than said predetermined distance.

3. The fire hydrant combination of claim 1 wherein said hydrant includes at least one horizontal outlet neck, a removable cap threadedly engaged with said outlet neck closing the outer end thereof, said cap including a central wall portion having a non-circular projection supported therefrom, said cap also including a plurality of lobes spaced outwardly from and about said projection and projecting outwardly beyond the projection a predetermined distance.

4. The fire hydrant combination of claim 3 including an elongated socket member having an endwise outwardly opening socket formed in one end thereof, said socket being non-circular in cross section and said one end of said socket member being telescopically engageable downwardly over said terminal end for imparting rotary torque thereto, the other end of said socket member including a laterally extending handle spaced from said one end of said socket member a distance greater than said predetermined distance, said one end of said socket member also being telescopingly engageable over said projection for imparting rotary torque thereto.

* * * * *